US010141131B2

(12) United States Patent
Li

(10) Patent No.: US 10,141,131 B2
(45) Date of Patent: Nov. 27, 2018

(54) PANEL-TYPE CONTROL BUTTON

(71) Applicant: Qingdao GoerTek Technology Co., Ltd., Qingdao (CN)

(72) Inventor: Geng Li, Qingdao (CN)

(73) Assignee: Qingdao Goertek Technology Co., Ltd., Qingdao, Shandong Province (CN)

( * ) Notice: Subject to any disclaimer, the term of this patent is extended or adjusted under 35 U.S.C. 154(b) by 0 days.

(21) Appl. No.: 15/754,045

(22) PCT Filed: May 25, 2016

(86) PCT No.: PCT/CN2016/083319
§ 371 (c)(1),
(2) Date: Feb. 21, 2018

(87) PCT Pub. No.: WO2017/036192
PCT Pub. Date: Mar. 9, 2017

(65) Prior Publication Data

US 2018/0254154 A1 Sep. 6, 2018

(30) Foreign Application Priority Data

Sep. 2, 2015 (CN) ..... 2015 1 0554886

(51) Int. Cl.
*H01H 13/10* (2006.01)
*H01H 13/14* (2006.01)
(Continued)

(52) U.S. Cl.
CPC ..... *H01H 13/10* (2013.01); *H01H 3/12* (2013.01); *H01H 13/14* (2013.01);
(Continued)

(58) Field of Classification Search
CPC ..... H01H 13/10; H01H 13/14; H01H 3/12; H01H 13/705
(Continued)

(56) References Cited

U.S. PATENT DOCUMENTS 5,144,103 A 9/1992 Suwa
8,772,661 B2 * 7/2014 Liang ..... H01H 3/122 200/341
2013/0292235 A1 * 11/2013 Baum ..... H01H 13/06 200/302.2

FOREIGN PATENT DOCUMENTS

CN 2415446 Y 1/2001
CN 2504746 Y 8/2002
(Continued)

OTHER PUBLICATIONS

International Search Report (PCT/ISA/210) dated Aug. 31, 2016, by the Chinese Patent Office as the International Searching Authority for International Application No. PCT/CN2016/083319.
(Continued)

*Primary Examiner* — Edwin A. Leon
*Assistant Examiner* — Lheiren Mae A Caroc
(74) *Attorney, Agent, or Firm* — Buchanan Ingersoll & Rooney PC

(57) ABSTRACT

A panel-type control button, including: a press key base, a press key panel, a switch board and a springback key. The press key panel is snap-fitted on the front surface of the press key base, and one end of the press key panel is rotatably mounted at one end of the press key base. The switch board is located on the back surface of the press key base, and is provided thereon with a switch element. The springback key is located above the switch element of the switch board. When the press key panel is pressed, the press key panel comes into contact with the springback key and triggers the switch element on the switch board, and further controls the
(Continued)

opening and closing of the switch element. The springback key provides a springback force for the press key panel to reset.

7 Claims, 4 Drawing Sheets

(51) Int. Cl.
*H01H 21/24* (2006.01)
*H01H 3/12* (2006.01)
*H01H 13/705* (2006.01)
*H01H 21/12* (2006.01)

(52) U.S. Cl.
CPC ..... *H01H 13/705* (2013.01); *H01H 21/24* (2013.01); *H01H 21/12* (2013.01); *H01H 2215/004* (2013.01); *H01H 2221/016* (2013.01)

(58) Field of Classification Search
USPC ..... 200/341, 343–345, 520
See application file for complete search history.

(56) References Cited

FOREIGN PATENT DOCUMENTS

| | | | |
|---|---|---|---|
| CN | 2590150 | Y | 12/2003 |
| CN | 201478173 | U | 5/2010 |
| CN | 201946479 | U | 8/2011 |
| CN | 202502928 | U | 10/2012 |
| CN | 203774135 | U | 8/2014 |
| CN | 204088151 | U | 1/2015 |
| CN | 105097337 | A | 11/2015 |
| CN | 204991557 | U | 1/2016 |
| SU | 1070618 | A1 | 1/1984 |

OTHER PUBLICATIONS

Written Opinion (PCT/ISA/237) dated Aug. 31, 2016, by the Chinese Patent Office as the International Searching Authority for International Application No. PCT/CN2016/083319, with English translation.

First Office Action dated Nov. 16, 2016 by The State Intellectual Property Office of People's Republic of China for Priority Application No. 201510554886.9, with English translation.

Second Office Action dated Jun. 27, 2017 by The State Intellectual Property Office of People's Republic of China for Priority Application No. 201510554886.9, with English translation.

Third Office Action dated Dec. 25, 2017 by The State Intellectual Property Office of People's Republic of China for Priority Application No. 201510554886.9, with English translation.

* cited by examiner

PANEL-TYPE CONTROL BUTTON

CROSS REFERENCE TO RELATED APPLICATIONS

This application is a National Stage entry of International Application No. PCT/CN2016/083319, filed on May 25, 2016, which claims priority to Chinese Patent Application No. 201510554886.9, filed on Sep. 2, 2015. The disclosure of the priority applications are hereby incorporated in their entirety by reference.

TECHNICAL FIELD

The present disclosure relates to the technical field of electro-mechanics, and particularly relates to a panel-type control button.

BACKGROUND ART

Buttons, as an element commonly used for controlling electric appliances, are seen everywhere in daily use electronic products. They can be classified as plane type (such as mice and keyboards) and side type (such as control switches for electric lamps) according to the design of electronic products. However, traditional designs of electronic buttons for household appliances have disadvantages such as large action space and high cost.

SUMMARY OF THE DISCLOSURE

In view of the above problems, the panel-type control button of the present disclosure is proposed to solve or partially solve the above problems. The panel-type control button according to the present disclosure can be simultaneously applied to the front face and the sidewalls of electronic products and synchronously realize the action of automatic resetting, and has advantages of small action space, full mechanical transmission, low cost, etc.

In order to achieve the above objects, the technical solutions of the present disclosure are as follows.

The present disclosure provides a panel-type control button, wherein the panel-type control button comprises: a press key base, a press key panel, a switch board and a springback key;

the press key panel is snap-fitted on a front surface of the press key base, and one end of the press key panel is rotatably mounted at one end of the press key base;

the switch board is located on a back surface of the press key base, and the switch board is provided thereon with a printed circuit board and a switch element;

the springback key is located above the switch element of the switch board; and when the press key panel is pressed, the press key panel comes into contact with the springback key and triggers the switch element on the switch board, and further controls the opening and closing of the switch mechanism; and the springback key provides a springback force for the press key panel to reset;

wherein the press key base comprises a rotation shaft and a bevel;

the bevel and a plane where a bottom surface of the press key base is located form a certain angle;

the rotation shaft is located on top of the bevel, and is fixed on the press key base; and a plane where the rotation shaft is located above the plane where the bottom surface of the press key base is located; and the bevel is provided thereon with a clipping hole and a boss relief hole;

wherein one surface of the press key panel is provided with a first buckle, a boss and a second buckle, and the second buckle is provided thereon with a rotation shaft groove;

the other surface of the press key panel is provided with a protrusion, a position of the protrusion corresponds to a position of the boss, and when the protrusion is pressed, the boss moves downwardly;

the first buckle matches the clipping hole on the press key base, the position of the first buckle corresponds to the position of the clipping hole, and the first buckle is snap-fitted in the clipping hole and is above the clipping hole by a certain distance;

the second buckle matches the rotation shaft on the press key base, the position of the second buckle corresponds to the position of the rotation shaft, and the second buckle is rotatably mounted on the rotation shaft via the rotation shaft groove; and the boss matches the boss relief hole on the press key base, the boss passes through the boss relief hole and is above the boss relief hole by a certain distance, and when the boss moves downwardly, the boss comes into contact with the springback key.

Optionally, the press key base is further provided thereon with a third buckle and a fourth buckle; the third buckle and the fourth buckle are for mounting the panel-type control button on an electronic product.

Optionally, the number of each of the rotation shaft, the first buckle, the second buckle, the third buckle and the fourth buckle is at least one.

Optionally, the switch board is further provided thereon with a position locking hole; and the position locking hole is for fixing the printed circuit board on the switch board.

Optionally, the springback key is provided thereon with a springback key contact point; and when the press key panel is pressed, the springback key contact point comes into contact with the switch element on the switch board and triggers the switch element.

Optionally, the material of the springback key is silicone pad.

Optionally, the springback key is a spring or an elastic sheet.

The advantageous effects of the present disclosure are as follows. The panel-type control button according to the present disclosure can be simultaneously applied to the front face and the sidewalls of electronic products and synchronously realize the action of automatic resetting. The bevel and the rotation shaft that are provided on the press key base of the panel-type control button bring the present disclosure the characteristics such as small action space, full mechanical transmission, low cost, being simple and easy to assemble, etc, and thus make it superior to traditional designs of electronic buttons for household appliances.

Figure 1:
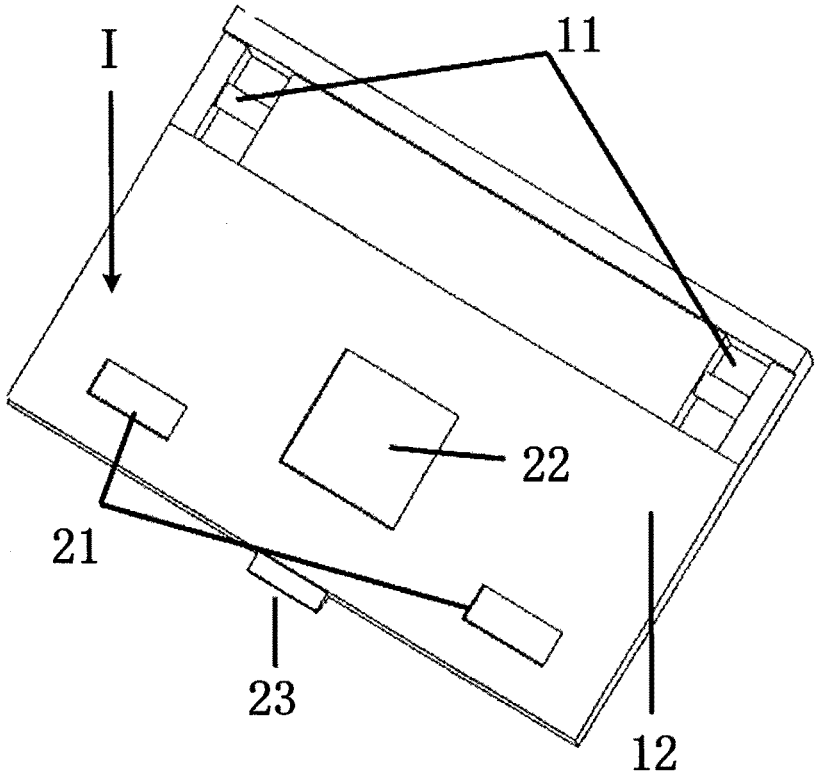
FIG. 1 is a front view of a schematic structure diagram of a press key base of a panel-type control button according to an embodiment of the present disclosure.

In the drawings: I is a press key base, II is a press key panel, III is a switch board, V is a springback key, 11 is a rotation shaft, 12 is a bevel, 21 is a clipping hole, 22 is a boss relief hole, 23 is a third buckle, 24 is a fourth buckle, 31 is a first buckle, 32 is a second buckle, 33 is a rotation shaft groove, 34 is a boss, 35 is a protrusion, 41 is a position locking hole, and 51 is a springback key contact point.

DETAILED DESCRIPTION

In order to make the objects, technical solutions and advantages of the present disclosure clearer, the embodiments of the present disclosure will be described below in further detail in conjunction with the drawings.

The present disclosure provides a panel-type control button, which can be simultaneously applied to the front face and the sidewalls of electronic products, and has a small action space, is purely mechanically transmitted and the cost is low.

Figure 2:
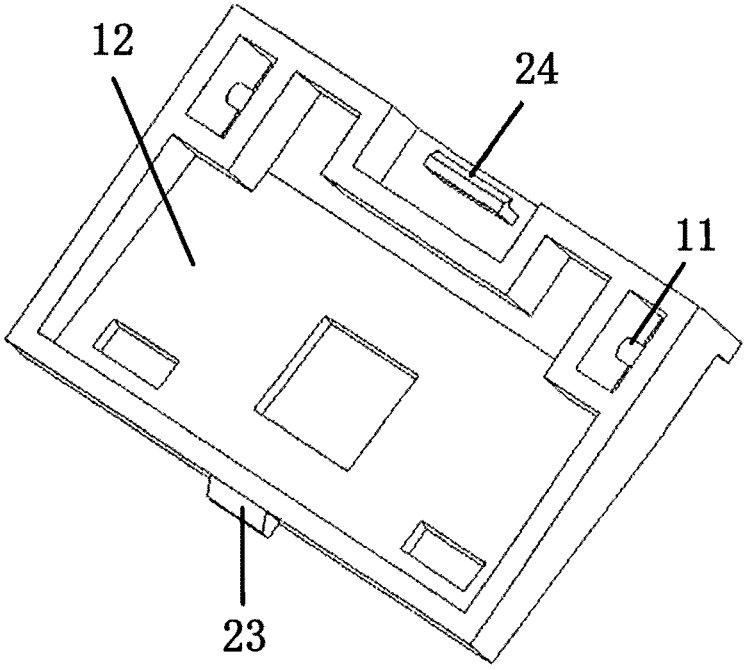
FIG. 2 is a back view of a schematic structure diagram of a press key base of a panel-type control button according to an embodiment of the present disclosure.
Figure 3:
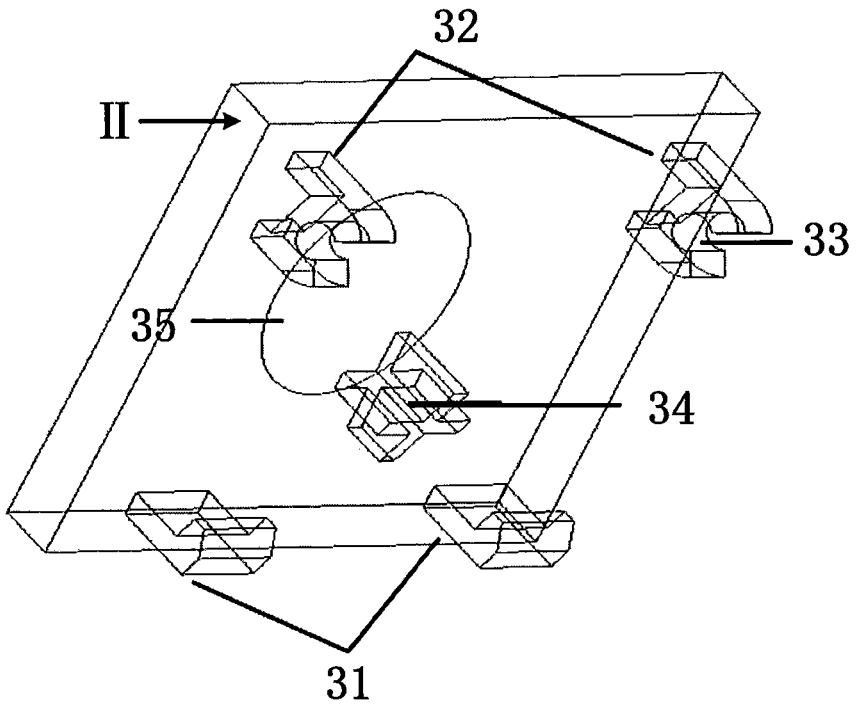
FIG. 3 is a perspective view of a schematic structure diagram of a press key panel of a panel-type control button according to an embodiment of the present disclosure.
Figure 4:
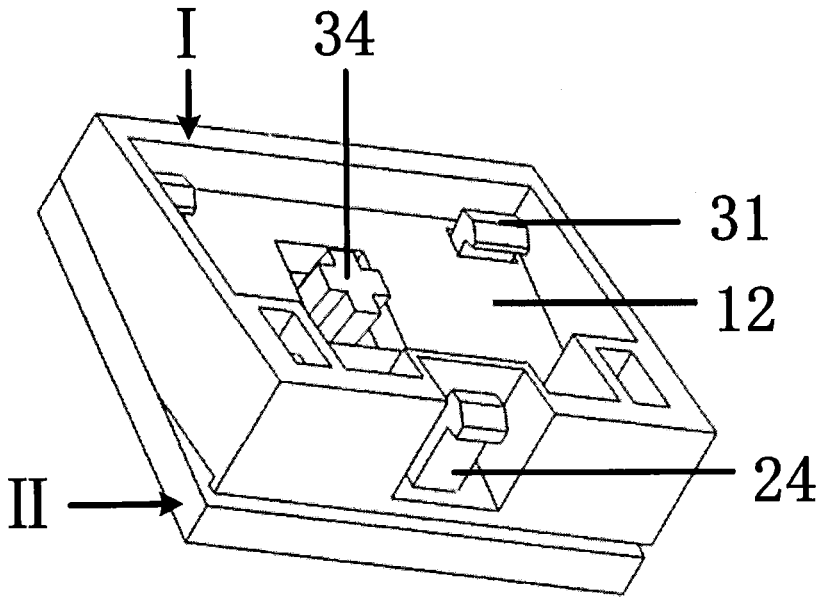
FIG. 4 is a back view of a schematic structure diagram of a press key panel of a panel-type control button according to an embodiment of the present disclosure when assembled on a press key base.
Figure 5:
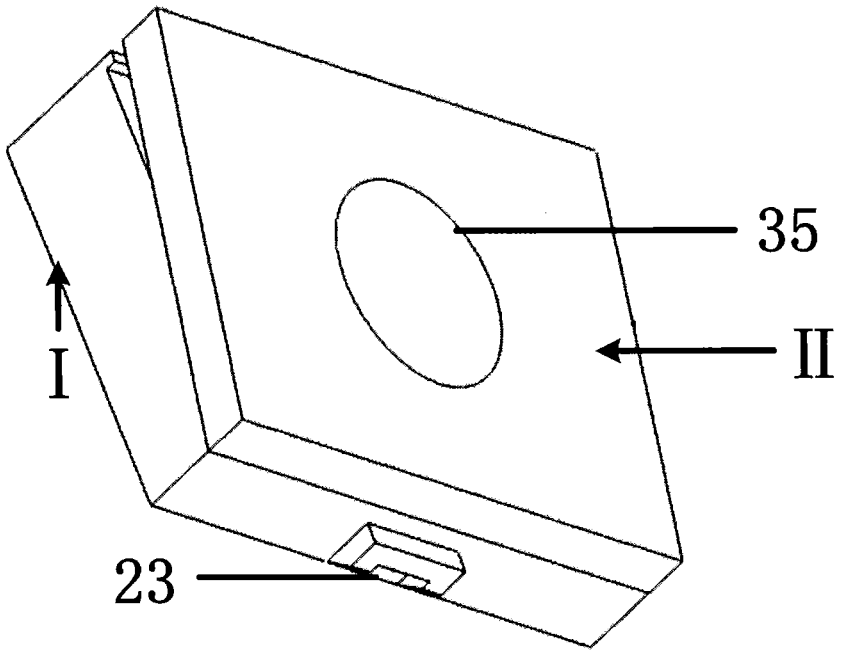
FIG. 5 is a front view of a schematic structure diagram of a press key panel of a panel-type control button according to an embodiment of the present disclosure when assembled on a press key base.
Figure 6:
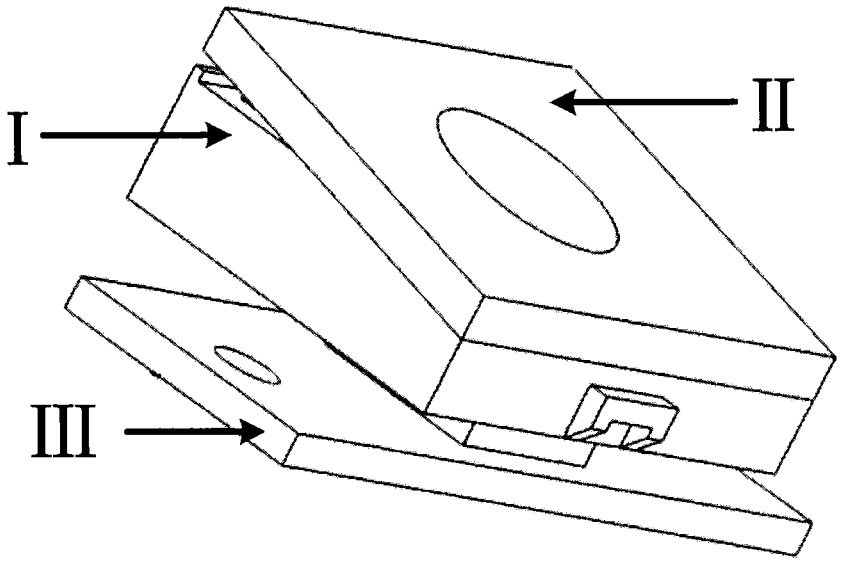
FIG. 6 is a front view of a schematic structure diagram of a panel-type control button according to an embodiment of the present disclosure after a press key panel, a press key base and a switch board are assembled.
Figure 7:
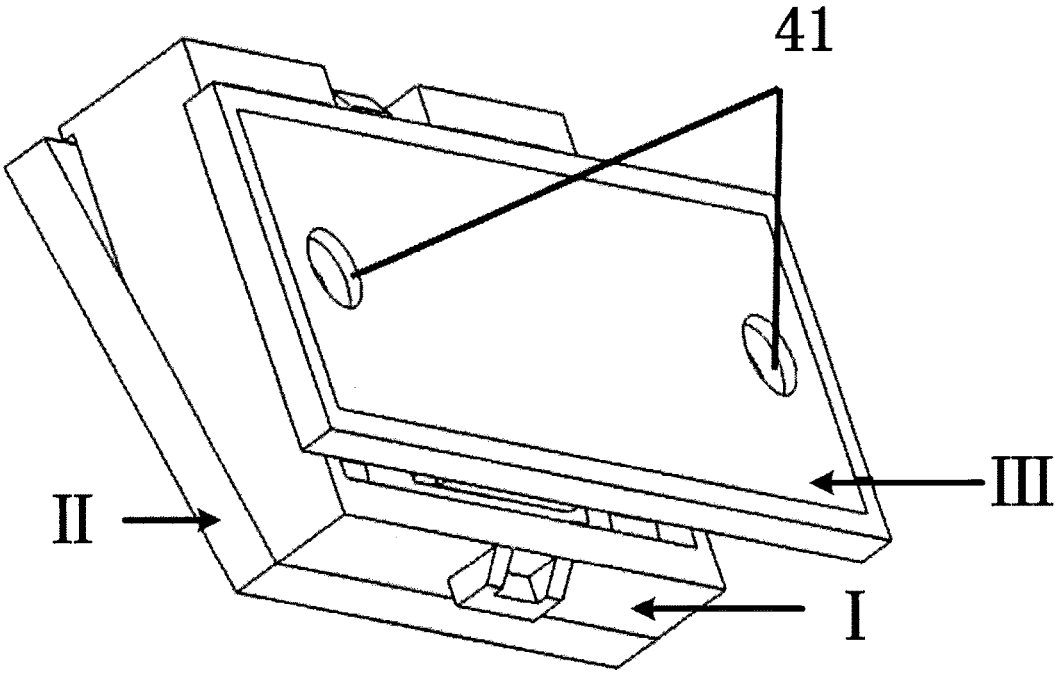
FIG. 7 is a back view of a schematic structure diagram of a panel-type control button according to an embodiment of the present disclosure after a press key panel, a press key base and a switch board are assembled.
Figure 8:
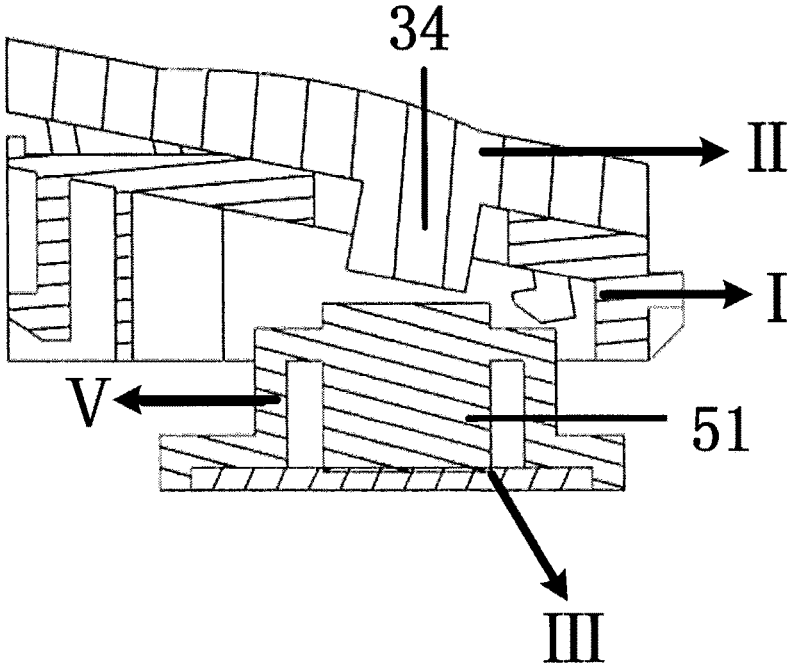
FIG. 8 is a sectional view of a panel-type control button according to an embodiment of the present disclosure.

FIG. 1 is the front view of a schematic structure diagram of the press key base of the panel-type control button according to an embodiment of the present disclosure. FIG. 2 is the back view of a schematic structure diagram of the press key base of the panel-type control button according to an embodiment of the present disclosure. FIG. 3 is a perspective view of a schematic structure diagram of the press key panel of the panel-type control button according to an embodiment of the present disclosure. FIG. 4 is the back view of a schematic structure diagram of the press key panel of the panel-type control button according to an embodiment of the present disclosure when assembled on the press key base. FIG. 5 is the front view of a schematic structure diagram of the press key panel of the panel-type control button according to an embodiment of the present disclosure when assembled on the press key base. FIG. 6 is a front view of a schematic structure diagram of a panel-type control button according to an embodiment of the present disclosure after a press key panel, a press key base and a switch board are assembled. FIG. 7 is a back view of a schematic structure diagram of a panel-type control button according to an embodiment of the present disclosure after a press key panel, a press key base and a switch board are assembled. FIG. 8 is the sectional view of the panel-type control button according to an embodiment of the present disclosure.

As shown in FIGS. 1-8, a panel-type control button of an embodiment of the present disclosure comprises: a press key base I, a press key panel II, a switch board III and a springback key V. The press key panel II is snap-fitted on the front surface of the press key base I, and one end of the press key panel II is rotatably mounted at one end of the press key base I. The switch board III is located on the back surface of the press key base I. The switch board III is provided thereon with a printed circuit board and a switch element (not shown in the figures). The switch element is provided on the printed circuit board, and the springback key V is located above the switch element of the switch board III (the direction directly facing the back side of the press key base I). When the press key panel II is pressed, the press key panel II comes into contact with the springback key V and triggers the switch element on the switch board III, and further controls the opening and closing of the switch element. The springback key V provides a springback force for the press key panel II to reset.

As shown in FIGS. 1 and 2, the press key base I comprises: a rotation shaft 11 and a bevel 12. The bevel 12 and the plane where the back surface of the press key base I is located form a certain angle, and the rotation shaft 11 is located on top of the bevel 12 and is fixed on the press key base I. The plane where the rotation shaft 11 is located is above the plane where the back surface of the press key base I is located. The bevel 12 is provided thereon with a clipping hole 21 and a boss relief hole 22.

As shown in FIGS. 3-5, one surface of the press key panel II is provided with a first buckle 31, a boss 34 and a second buckle 32, and the second buckle 32 is provided with a rotation shaft groove 33 thereon. The other surface of the press key panel II is provided with a protrusion 35, and the position of the protrusion 35 corresponds to the position of the boss 34. The protrusion 35 can increase the tactile sensation when the user presses.

As shown in FIG. 4, the press key panel II is mounted on the front surface of the press key base I. The first buckle 31 matches the clipping hole 21 on the press key base I, and the position of the first buckle 31 corresponds to the position of the clipping hole 21. The first buckle 31 is snap-fitted in the clipping hole 21 and is above the clipping hole 21 by a certain distance, so that when the user presses the press key panel II the press key panel II has a certain action space. In the embodiment of the present disclosure, the first buckle 31 is snap-fitted in the clipping hole 21 and is above the clipping hole 21 by 2 mm.

The second buckle 32 matches the rotation shaft 11 on the press key base I, the position of the second buckle 32 corresponds to the position of the rotation shaft 11, and the second buckle 32 is rotatably mounted on the rotation shaft 11 via the rotation shaft groove 33. The boss 34 matches the boss relief hole 22 on the press key base I; the boss 34 passes through the boss relief hole 22 and is above the boss relief hole 22 by a certain distance. When the boss 34 moves downwardly, the boss 34 comes into contact with the springback key V. In the embodiment of the present disclosure, the boss 34 passes through the boss relief hole 22 and is above the boss relief hole 22 by 2 mm, so that when the press key panel II is pressed the boss 34 comes into contact with the corresponding springback key V.

As shown in FIGS. 4-8, the springback key V is provided thereon with a springback key contact point 51; the springback key contact point 51 is located at the middle part of the springback key V, and corresponds to the position of the switch element on the printed circuit board of the switch board III. When the protrusion 35 on the press key panel II is pressed, the press key panel II rotates about the rotation shaft 11, the boss 34 moves downwardly along with it (toward the direction of the switch board), the boss 34 comes into contact with the springback key V and presses downwardly the springback key V, the springback soft key V descends vertically, and the rotation traveling of the press key panel II switches to vertical traveling, and the action space is relatively small. Then, the springback soft key contact point 51 comes into contact with the switch mechanism on the switch board III and triggers the switch element on the printed circuit board, thereby the circuit is turned on and control the turning-on and turning-off of an instruction or a circuit (such as a toilet flushing instruction). The springback key V provides a springback force to cause the boss 34 and the press key panel II to spring back and automatically reset, thereby the springback key contact point 51 and the switch element on the switch board III are separated, and the circuit is turned off.

It can be seen from above that, the panel-type control button of the embodiment of the present disclosure is a switch element transmitted and triggered purely mechanically, and its cost is relatively low.

It should be noted that, the material of the springback key V in the embodiment of the present disclosure is silicone pad. Optionally, the springback key V may also be a spring or an elastic sheet, as long as it can realize the function of automatic springback of the press key panel II.

As shown in FIG. 7, the switch board III is further provided thereon with a position locking hole 41, and the position locking hole 41 is for fixing the printed circuit board on the switch board III.

As shown in FIG. 2, the press key base I is further provided thereon with a third buckle 23 and a fourth buckle 24. The third buckle 23 and the fourth buckle 24 are for mounting the panel-type control button on an electronic product. The number of each of the rotation shaft 11, the first buckle 31, the second buckle 32, the third buckle 23 and the fourth buckle 24 is at least one. In the embodiment of the present disclosure, the number of each of the rotation shaft 11, the first buckle 31 and the second buckle 32 is two, and the two are symmetrically distributed. The number of either of the third buckle 23 and the fourth buckle 24 is one, and they are located at the center positions of the edges of the press key base I.

In conclusion, the panel-type control button according to the present disclosure has the following advantageous effects:

(1) it has a function of automatic resetting;

(2) it has a small action space;

(3) it has a simple structure and is easy to assemble; and (4) it is purely mechanically transmitted and its cost is low.

The above description is merely preferable embodiments of the present disclosure, and is not used to limit the protection scope of the present disclosure. Any modifications, equivalent substitutions or improvements that are made within the spirit and principle of the present disclosure are all included in the protection scope of the present disclosure.

What is claimed is:

1. A panel-type control button, comprising: a press key base, a press key panel, a switch board and a springback soft key;

the press key panel is snap-fitted on a front surface of the press key base, and one end of the press key panel is rotatably mounted at one end of the press key base;

the switch board is located on a back surface of the press key base, and the switch board is provided thereon with a printed circuit board and a switch element;

the springback key is located above the switch element of the switch board; and when the press key panel is pressed, the press key panel comes into contact with the springback key and triggers the switch element on the switch board, and further controls the opening and closing of the switch element; and the springback key provides a springback force for the press key panel to reset;

wherein the press key base comprises a rotation shaft and a bevel;

the bevel and a plane where the back surface of the press key base is located form a certain angle;

the rotation shaft is located on top of the bevel, and is fixed on the press key base; and a plane where the rotation shaft is located above the plane where the back surface of the press key base is located; and the bevel is provided thereon with a clipping hole and a boss relief hole;

wherein one surface of the press key panel is provided with a first buckle, a boss and a second buckle, and the second buckle is provided thereon with a rotation shaft groove;

the other surface of the press key panel is provided with a protrusion, a position of the protrusion corresponds to a position of the boss, and when the protrusion is pressed, the boss moves downwardly;

the first buckle matches the clipping hole on the press key base, the position of the first buckle corresponds to the position of the clipping hole, and the first buckle is snap-fitted in the clipping hole and is above the clipping hole by a certain distance;

the second buckle matches the rotation shaft on the press key base, the position of the second buckle corresponds to the position of the rotation shaft, and the second buckle is rotatably mounted on the rotation shaft via the rotation shaft groove; and the boss matches the boss relief hole on the press key base, the boss passes through the boss relief hole and is above the boss relief hole by a certain distance, and when the boss moves downwardly, the boss comes into contact with the springback key.

2. The panel-type control button according to claim 1, wherein the press key base is further provided thereon with a third buckle and a fourth buckle; the third buckle and the fourth buckle are for mounting the panel-type control button on an electronic product.

3. The panel-type control button according to claim 2, wherein the number of each of the rotation shaft, the first buckle, the second buckle, the third buckle and the fourth buckle is at least one.

4. The panel-type control button according to claim 1, wherein the switch board is further provided thereon with a position locking hole; and the position locking hole is for fixing the printed circuit board on the switch board.

5. The panel-type control button according to claim 1, wherein the springback key is provided thereon with a springback key contact point; and when the press key panel is pressed, the springback key contact point comes into contact with the switch element on the switch board and triggers the switch element.

6. The panel-type control button according to claim 5, wherein the material of the springback key is silicone pad.

7. The panel-type control button according to claim 5, wherein the springback key is a spring or an elastic sheet.

* * * * *